US008801308B2

(12) United States Patent
Cole et al.

(10) Patent No.: US 8,801,308 B2
(45) Date of Patent: Aug. 12, 2014

(54) PRINTING DEVICE INTERNAL LIGHTING

(75) Inventors: David R. Cole, Bedforshire (GB); Richard G. Hubbard, Southill Beds (GB); David K. Halden, Hertfordshire (GB); Kenneth G. Dixon, Hertfordshire (GB); Anthony J. Peters, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 431 days.

(21) Appl. No.: 13/045,836

(22) Filed: Mar. 11, 2011

(65) Prior Publication Data

US 2012/0230747 A1 Sep. 13, 2012

(51) Int. Cl.
*B41J 11/42* (2006.01)

(52) U.S. Cl.
USPC ..... 400/693; 400/692; 400/582; 400/691; 399/16; 399/18; 399/21; 399/9; 399/11; 439/217; 439/218

(58) Field of Classification Search
USPC ..... 400/582; 399/9, 11, 16, 18, 21; 200/1 R, 200/51 R, 51.11, 51.12, 296, 298; 439/217, 439/218, 357, 366, 529, 603
See application file for complete search history.

(56) References Cited

U.S. PATENT DOCUMENTS

| | | | | |
|---|---|---|---|---|
| 4,897,769 | A | 1/1990 | Lang | |
| 6,032,004 | A | 2/2000 | Mirabella, Jr. et al. | |
| 6,658,218 | B2 | 12/2003 | Krolczyk et al. | |
| 6,701,095 | B1 * | 3/2004 | Fujimoto et al. | 399/9 |
| 7,092,646 | B2 * | 8/2006 | Schroath et al. | 399/21 |
| 7,484,731 | B2 * | 2/2009 | Gutierrez-Vazquez et al. | 271/258.04 |
| 2002/0191416 | A1 | 12/2002 | Wesson | |
| 2004/0022548 | A1 * | 2/2004 | Nagaoka | 399/16 |
| 2005/0201765 | A1 * | 9/2005 | Shinga | 399/16 |
| 2006/0256037 | A1 | 11/2006 | Kerr | |
| 2008/0047448 | A1 * | 2/2008 | Cocklin et al. | 101/483 |
| 2010/0206048 | A1 * | 8/2010 | Locke | 73/31.03 |
| 2011/0310419 | A1 * | 12/2011 | Yoshie | 358/1.13 |

FOREIGN PATENT DOCUMENTS

| | | | | |
|---|---|---|---|---|
| JP | 2001130786 A * | 5/2001 | | B65H 7/06 |

* cited by examiner

*Primary Examiner* — Judy Nguyen
*Assistant Examiner* — Quang X Nguyen
(74) *Attorney, Agent, or Firm* — Gibb & Riley, LLC

(57) ABSTRACT

A printing apparatus includes a media path within a body of the printing apparatus. The media path moves sheets of media through the body of the printing apparatus. A marking engine is also within the body of the printing apparatus. The media path supplies the printing media to the marking engine. A processor is within the body of the printing apparatus. The processor is operatively connected to the marking engine, and the processor controls actions of the marking engine. Sensors are within the body of the printing apparatus. The sensors are operatively connected to the processor, and the sensors are positioned along the media path. The sensors detect locations and conditions of the sheets of media as the sheets of media travel along the media path. The sensors have a first clip shape. Further, clip connectors are located within the body of the printing apparatus. The clip connectors are connected to the sensors. Additionally, light structures are connected to the clip connectors. The light structures have an identical shape as the sensors for connecting to the clip connectors.

19 Claims, 7 Drawing Sheets

PRINTING DEVICE INTERNAL LIGHTING

BACKGROUND

Embodiments herein generally relate to electrostatic printers and copiers or reproduction machines, and more particularly, concerns lighting devices that illuminate the interior areas of such machines.

Modern printing devices are sophisticated machines that are able to process a wide variety of print media at very high speeds and produce almost lifelike quality images. However, occasionally a user or service engineer needs to access the interior regions of such printing machines. Often, it is difficult to see around and between the multitude of closely spaced individual working elements that such printing machines may include. The embodiments described below assists in such efforts and make it easier to see items that are located within the internal confines of a printing machine.

SUMMARY

Embodiments herein include a printing apparatus that comprises a body and a media supply operatively connected to the body of the printing apparatus. Herein an item is "operatively" connected to another item when it is directly or indirectly connected (electrically, mechanically, functionally, etc.) to the other item. The media supply stores sheets of media and there is a media path within the body of the printing apparatus (which has a beginning, a middle, and an end) and the beginning of the media path is adjacent the media supply. The media path moves the sheets of media through the body of the printing apparatus from the beginning to the end.

A marking engine is also included within the body of the printing apparatus. The middle of the media path is adjacent the marking engine. The media path supplies the printing media to the marking engine, and the marking engine prints marks on the printing media in a printing process to create printed sheets. A media exit is operatively connected to the body of the printing apparatus. The end of the media path is adjacent the media exit, and the media path moves the printed sheets from the marking engine to the media exit.

A processor is included within the body of the printing apparatus. The processor is operatively connected to the marking engine. The processor controls actions of the marking engine. In addition, sensors are positioned within the body of the printing apparatus. The sensors are operatively connected to the processor and are positioned along the media path. The sensors detect locations and conditions of the sheets of media as the sheets of media travel along the media path in order to identify paper jams within the media path.

Further, lights (e.g., light structures) are located within the body of the printing apparatus to illuminate the interior of the printing apparatus body. The light structures comprise light emitting diodes, incandescent lights, fluorescent lights, compressed gas lights, vapor light structures, etc., and are positioned and sized to have a luminance level sufficient to illuminate a paper jam.

There are also clip connectors within the body of the printing apparatus. The clip connectors are connected to the sensors and the light structures. The clip connectors provide electrical communication between the sensors and the processor, and between the light structures and the processor. The sensors and light structures both have the same "first" clip shape and the clip connectors have a mating (mirroring) "second" clip shape corresponding to and fitting the first clip shape. Thus, for example, the sensors and the light structures have first catches that correspond to second catches on the clip connectors. The first clip shape and the second clip shape form a physical and electrical connection between the sensors and light structures, and the clip connectors.

Doors and/or drawers are positioned on the body of the printing apparatus to allow access to the internal areas of the body of the printing apparatus, and door and drawer sensors are positioned on the doors and drawers. The door and drawer sensors are operatively connected to the processor and the processor can activate the light structures when the door and drawer sensors detect one of the doors and/or drawers being open, in order to illuminate the internal areas of the body of the printing apparatus.

Additionally, a graphic user interface is positioned on the body of the printing apparatus and is operatively connected to the processor. The graphic user interface can provide sequential instructions to guide a user through a multi-step process of checking different areas of the media path to remove a paper jam. The processor can also sequentially activate different ones of the light structures to illuminate the different areas of the media path in coordination with the sequential instructions. When the processor is sequentially activating the different light structures in coordination with the sequential instructions, the processor only activates one or more of the light structures that are located an area of the media path about which the graphic user interface is currently providing paper jam clearing instructions, and the processor deactivates all other ones of the lighting structures to highlight for the user the area that the instructions on the graphic user interface currently identify as needing to be cleared.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, it can be difficult to see around and between the multitude of closely spaced individual working elements that printing machines may include. For example, customers can experience difficulty in seeing pieces of paper in the paper path of a printing machine when a paper jam occurs. The embodiments herein address this issue by providing additional lighting within the framework of the machine.

Further, the lights provided by embodiments herein contain identical connectors as are used for the various sensors within the printing machine. This allows the light structures to be easily added to existing printing machine designs because such light structures can be plugged into the existing connectors used for sensors.

Additionally, by connecting the light structures to the wiring used for various sensors, this allows the light structures to be controlled by the processor. Because the light structures are controlled by the processor, the lights can be sequentially activated (turned on) in coordination with instructions provided on the graphic user interface. Therefore, when the graphic user interface provides instructions for the user or service engineer to perform activity in a specific internal area of the printing machine, the processor can selectively activate less than all of the interior lights so as to only illuminate that specific internal area that relates to the instructions being currently displayed on the graphic user interface.

Figure 1:
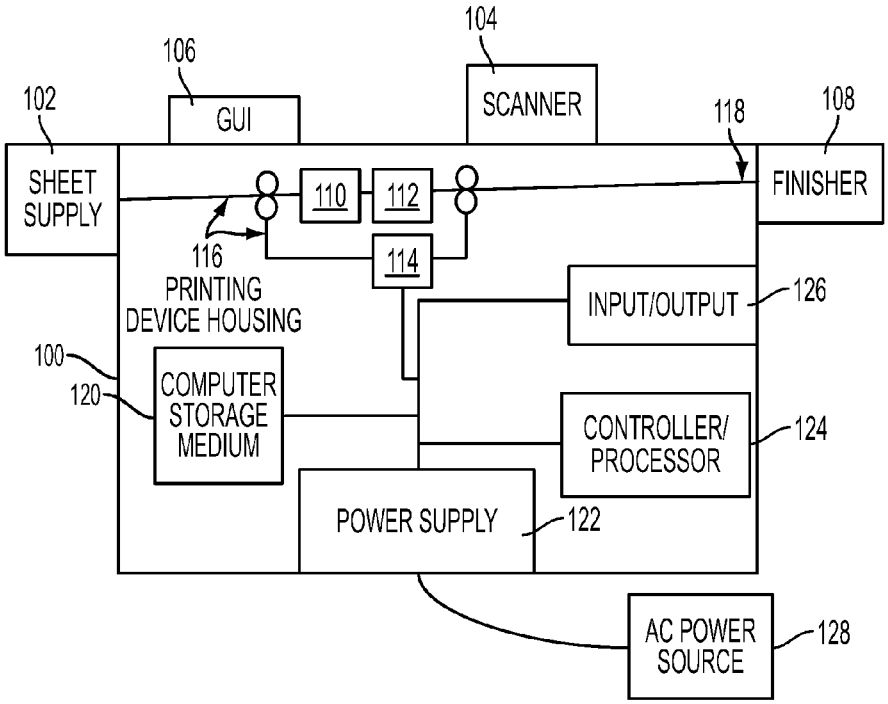
FIG. 1 is a side-view schematic diagram of a device according to embodiments herein.
Figure 2:
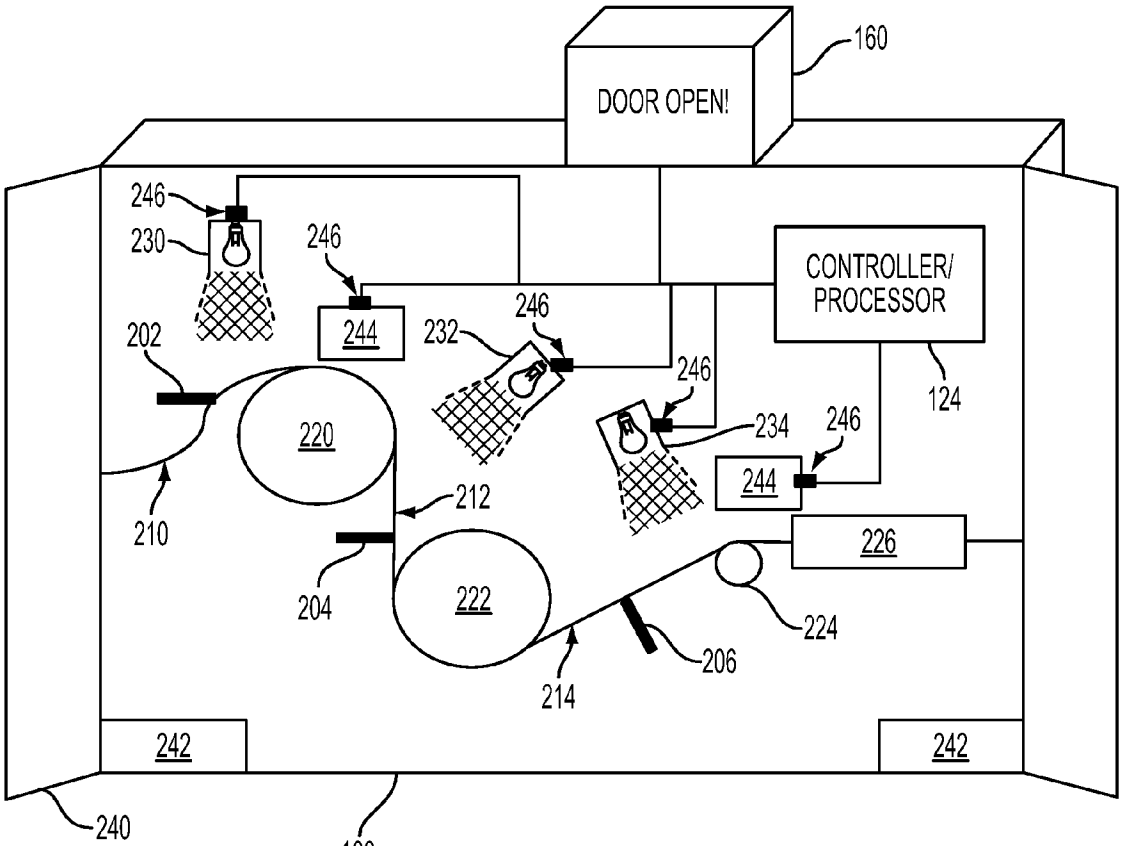
FIG. 2 is a perspective side-view schematic diagram of a device according to embodiments herein that has the doors or drawers open.

FIG. 1 illustrates a computerized printing device 100, which can be used with embodiments herein and can comprise, for example, a printer, copier, multi-function machine, etc. The printing device 100 includes a controller/processor 124, at least one marking device (printing engines) 110, 112, 114 operatively connected to the processor 124, a media path 116 positioned to supply sheets of media from a sheet supply 102 to the marking device(s) 110, 112, 114, and a communications port (input/output) 126 operatively connected to the processor 124 and to a computerized network external to the printing device. After receiving various markings from the printing engine(s), the sheets of media can optionally pass to a finisher 108 which can fold, staple, sort, etc., the various printed sheets.

Thus, the media supply 102 stores sheets of media and there is a media path 116 within the body 100 of the printing apparatus (which has a beginning, a middle, and an end) and the beginning of the media path 116 is adjacent the media supply 102. The media path 116 moves the sheets of media through the body 100 of the printing apparatus from the beginning to the end.

The middle of the media path 116 is adjacent the marking engine 110, 112, 114. The media path 116 supplies the printing media to the marking engine 110, 112, 114, and the marking engine 110, 112, 114 prints marks on the printing media in a printing process to create printed sheets. A media exit 118 is operatively connected to the body 100 of the printing apparatus and to the finisher 108. The end of the media path 116 is adjacent the media exit 118, and the media path 116 moves the printed sheets from the marking engine 110, 112, 114 to the media exit 118.

Also, the printing device 100 can include at least one accessory functional component (such as a scanner/document handler 104, sheet supply 102, finisher 108, etc.) and a graphic user interface assembly 106 that also operate on the power supplied from the external power source 128 (through the power supply 122).

The input/output device 126 is used for communications to and from the multi-function printing device 100. The processor 124 controls the various actions of the printing device. A non-transitory computer storage medium device 120 (which can be optical, magnetic, capacitor based, etc.) is readable by the processor 124 and stores instructions that the processor 124 executes to allow the multi-function printing device to perform its various functions, such as those described herein.

Thus, a printer body housing 100 has one or more functional components that operate on power supplied from the alternating current (AC) 128 by the power supply 122. The power supply 122 connects to an external alternating current power source 128 and converts the external power into the type of power needed by the various components.

As would be understood by those ordinarily skilled in the art, the printing device 100 shown in FIG. 1 is only one example and the embodiments herein are equally applicable to other types of printing devices that may include fewer components or more components. For example, while a limited number of printing engines and paper paths are illustrated in FIG. 1, those ordinarily skilled in the art would understand that many more paper paths and additional printing engines could be included within any printing device used with embodiments herein.

FIGS. 2-5 present different schematic diagrams of a portion of the same printing body 100 housing 100. More specifically, starting with FIG. 2, the printer body 100 can include door and/or drawers 240 positioned on the body 100 that allow access to the internal areas of the body 100 of the printing apparatus. Note that the various internal elements such as: roll elements 220, 222, 224 (which can be, for example, transfer rolls, fuser rolls, support rolls, etc.); handles 202, 204, 206; media support elements 210, 212, 214 (which can be belts, guides, roller nips, etc.); and other processing elements 226 (which can comprise any element commonly found within a printing device) are only a portion of the actual elements that may be included within a given printing device. Further, the shape, location, and size, of such elements is not necessarily drawn to scale and would vary from machine to machine. Therefore, it would be understood by those ordinarily skilled in the art that FIGS. 2-5 only illustrate a partial internal view of a simplified example of the internal arrangement within an exemplary printing machine and that the embodiments herein are equally applicable to many other types of printing machines that may contain many more (or less) components and elements.

Further, door and drawer sensors 242 are positioned adjacent the door and drawers 240. The door and drawer sensors 242 are operatively connected to the processor 124 and the processor 124 can simultaneously activate all light structures 230, 232, 234 when the door and drawer sensors 242 detect that one or more of the doors and/or drawers 240 is open, in order to illuminate the internal areas of the body 100 of the printing apparatus. Herein an item is "operatively" connected to another item when it is directly or indirectly connected (electrically, mechanically, functionally, etc.) to the other item.

In addition, sensors 244 are positioned within the body 100 of the printing apparatus. The sensors 244 are operatively connected to the processor 124 and are positioned along the media path 116. In FIGS. 2-5, items 210, 212, 214, 220, 222, 224, 226, etc., represent portions of the media path 116 shown in FIG. 1. The sensors 244 detect (among other conditions) locations and conditions of the sheets of media as the sheets of media travel along the media path 116 in order to assure that the printing process is occurring properly and to identify abnormalities, such as paper jams within the media path 116.

Further, the lights (e.g., light structures 230, 232, 234) are located within the body 100 of the printing apparatus to illuminate the interior of the printing apparatus body 100. The light structures 230, 232, 234 comprise any form of device that produces light, including, but not limited to light emitting diodes, incandescent lights, fluorescent lights, compressed gas lights, vapor light structures, etc., and are positioned and sized to have a luminance level sufficient to illuminate at least one internal area of the body 100 (to, for example, illuminate a paper jam). In combination, the light structures 230, 232, 234 can provide sufficient illumination to allow all internal areas of the body 100 to be easily viewed by the unaided human eye without the need for additional light sources (such as flashlights, external lights, etc.). Thus, for example, each light structure 230, 232, 234 could produce at least 50 lumens (4000 mcd), and in most applications produces much more (200 lm (15,000 mcd); 500 lm (40,000 mcd); 1500 lm (115,000 mcd); etc.) and is much brighter than indicator or panel lights that do not significantly illuminate the space around them.

There are also quick-connect/disconnect clip connectors 246 within the body 100 of the printing apparatus. The clip connectors 246 are connected to the sensors 244 and the light structures 230, 232, 234 at the end of the wiring that leads to the processor 124. The clip connectors 246 provide electrical communication between the sensors 244 and the processor 124, and between the light structures 230, 232, 234 and the processor 124. The sensors 244 and light structures 230, 232, 234 can both have the same identical "first" clip shape and the clip connectors 246 can have a mating (mirroring) "second" clip shape corresponding to and fitting the first clip shape.

Figure 3:
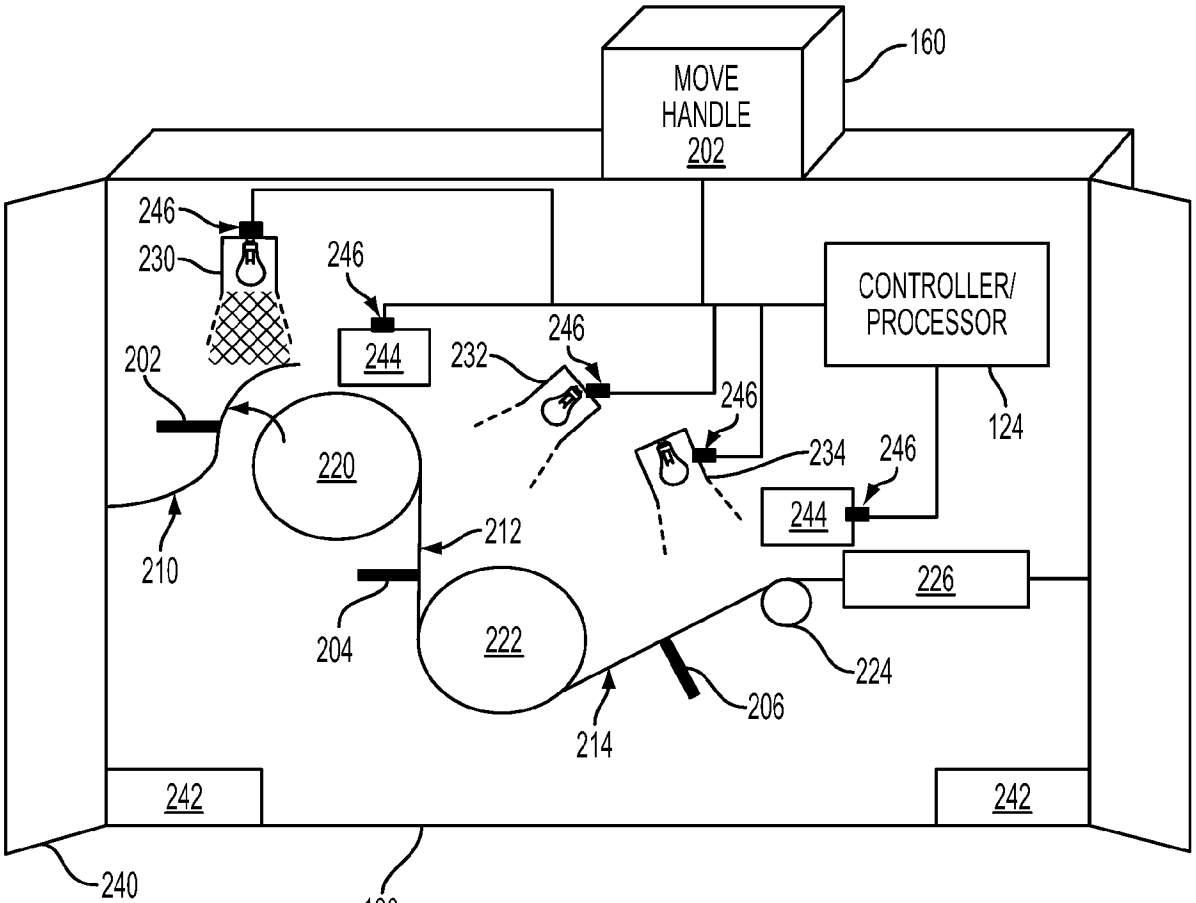
FIG. 3 is a perspective side-view schematic diagram of a device according to embodiments herein that has the doors or drawers open.
Figure 4:
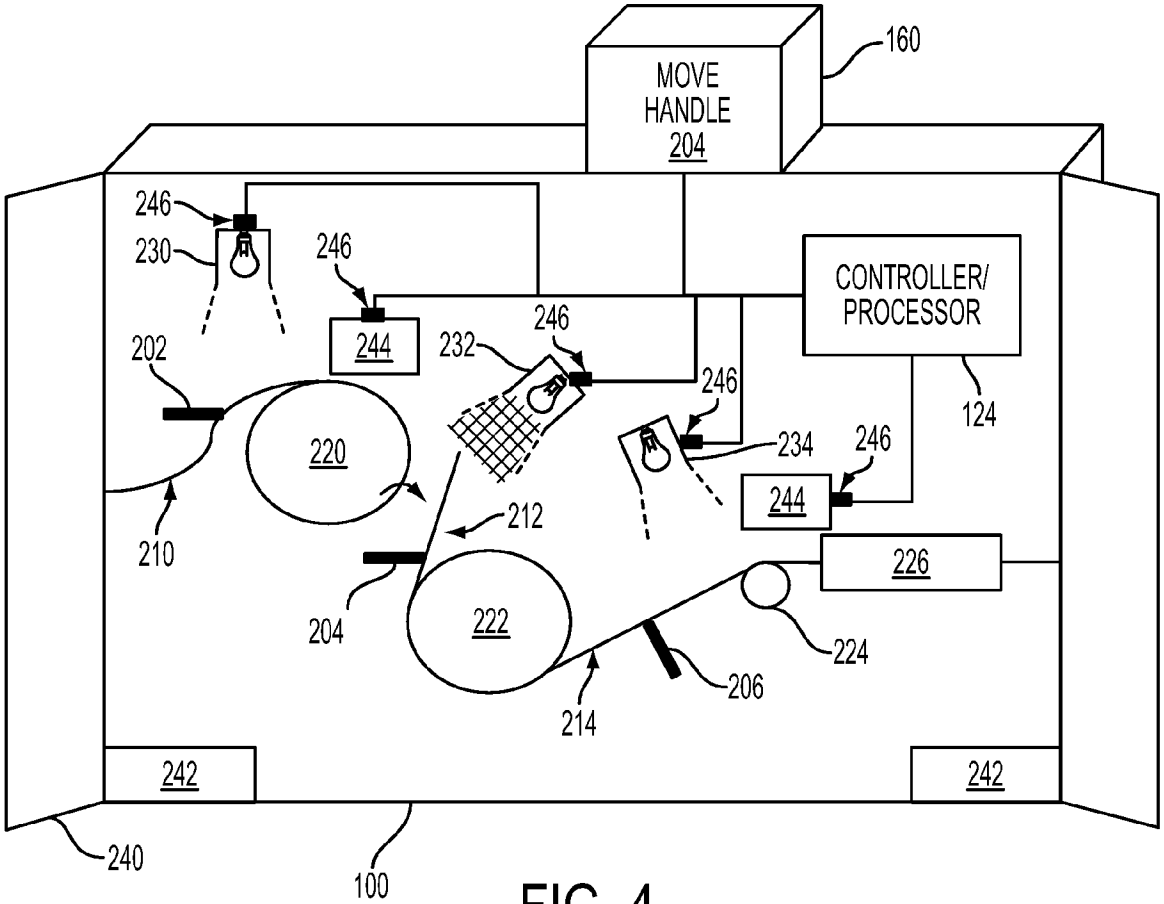
FIG. 4 is a perspective side-view schematic diagram of a device according to embodiments herein that has the doors or drawers open.
Figure 5:
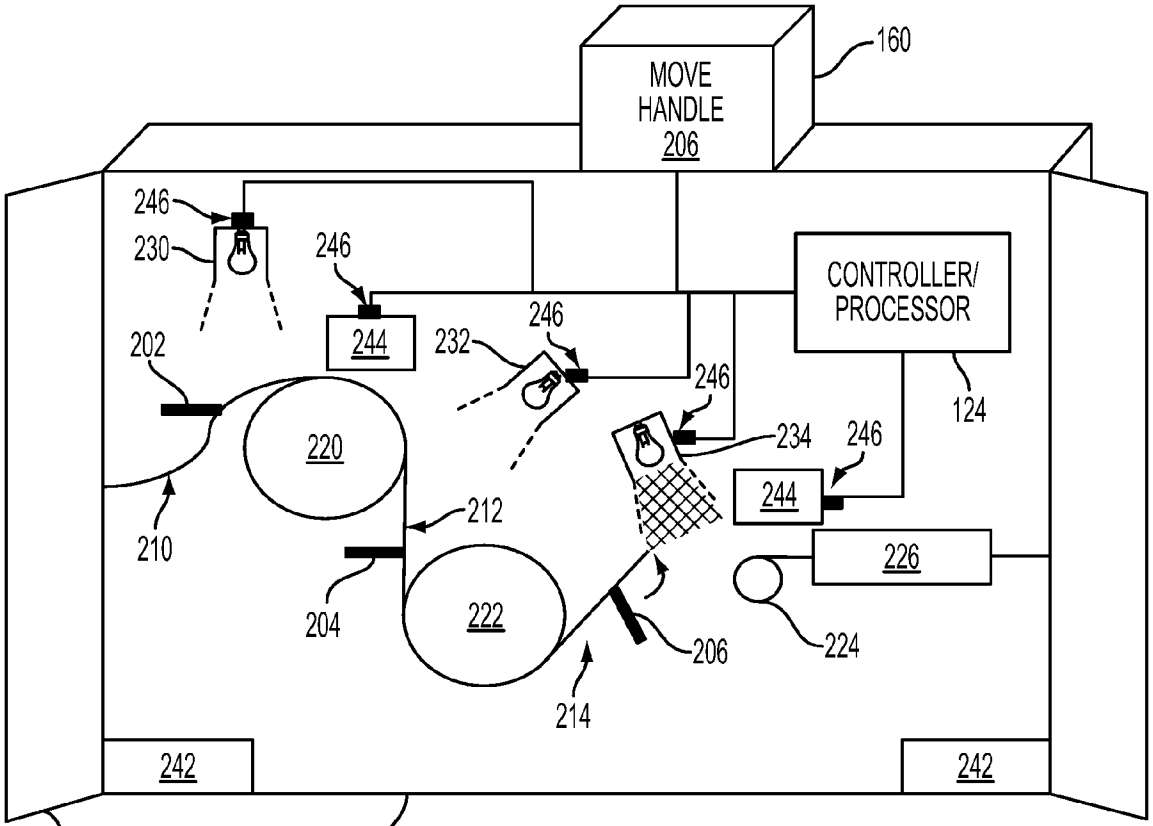
FIG. 5 is a perspective side-view schematic diagram of a device according to embodiments herein that has the doors or drawers open.

Additionally, in FIGS. 2-5 a graphic user interface 160 is shown as being positioned on the body 100 of the printing apparatus (and operatively connected to the processor 124). The graphic user interface 160 can provide sequential instructions to guide a user through a multi-step process of checking different areas of the media path 116 to remove a paper jam. As shown in FIGS. 3-5, the processor 124 can also sequentially activate different ones of the light structures 230, 232, 234 to illuminate the different areas of the media path 116 in coordination with the sequential instructions. When the processor 124 is sequentially activating the different light structures 230, 232, 234 in coordination with the sequential instructions, the processor 124 only activates one or more of the light structures 230, 232, 234 that are located in an area of the media path 116 about which the graphic user interface 160 is currently providing paper jam clearing instructions, and the processor 124 deactivates all other ones of the lighting structures to highlight for the user the area that the instructions on the graphic user interface 160 currently identify as needing to be cleared (and to conserve power usage).

Therefore, as shown, for example in FIG. 3, the graphic user interface 160 includes an instruction to the user to move handle number 202 using the message "move handle 202." Simultaneously, the lighting structure 230 is illuminated to shine light on media path section 210, handle 202, roll 220, etc.; and, at the same time, light structures 232 and 234 are deactivated (meaning they do not produce visible light). This draws the user's attention to handle 202 and allows the user to more easily locate handle 202 to cause section 210 of the media path to be lifted off roll 220 and help clear the potential paper jam. Similarly, as shown in FIGS. 4 and 5, the message on the graphic user interface 160 changes to instruct the user to sequentially move handles 204 and 206 and light structures 232 and 234 are sequentially illuminated in coordination with such graphic user interface instructions while all other lights are deactivated. More specifically, FIG. 4 relates to only illuminating and moving handle 204 while FIG. 5 relates to only illuminating and moving handle 206.

Figure 6:
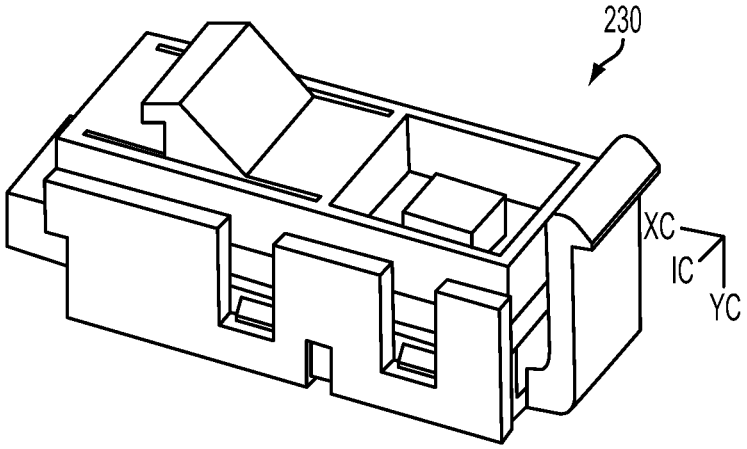
FIG. 6 is a perspective schematic diagram of a light structure according to embodiments herein that has the doors or drawers open.
Figure 7:
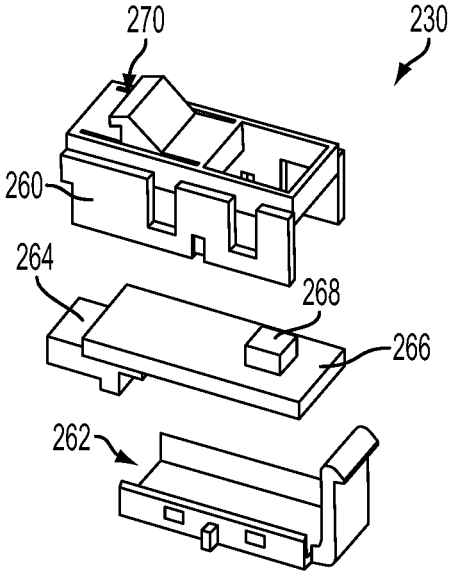
FIG. 7 is an exploded perspective schematic diagram of a light structure according to embodiments herein that has the doors or drawers open.
Figure 8:
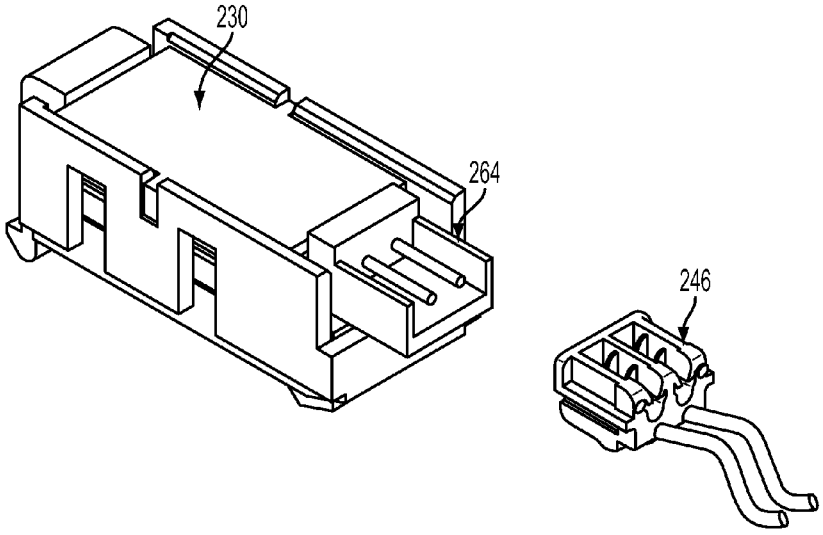
FIG. 8 is a perspective schematic diagram of a light structure according to embodiments herein that has the doors or drawers open.

FIGS. 6-8 illustrate an example of one of the light structures 230. As shown in exploded view in FIG. 7, the light structure 230 can include external body sections 260, 262 that comprise, for example, a two part plastic housing, which all snaps together to assemble. The external body sections 260, 262 can be the same (or very similar) as that used for the sensors 244. As also shown in FIG. 7, a single surface-mounted LED 268 is mounted on the same circuit board 266 to which an electrical connector 264 is mounted. Again, this is only one example of many different forms that the light structures herein could take, and the embodiments herein are not limited to this simplified example.

As shown in exploded view in FIG. 7, the external body sections 260, 262 can have first catches 270 that correspond to second catches on printer frame structure. The first clip shape of the first catches 270 and the second clip shape of the second catches form a physical connection (quick connect/disconnect) that snap and unsnap. As shown in FIG. 8, the sensor clip connectors 246 include a mating electrical connector that is shaped to receive and electrically connect to the electrical connector 264. The housing 260, 262 then can be snap mounted virtually anywhere in the machine.

By using the circuit board 266, all the electrical components are housed in the lighting module 230. The design offers plug and play type functionality, where the component is self contained and only needs the harness and sensor clip connector 246 to be connected. This provides a low-cost, easy to connect and disconnect, compact unit that allows lighting to be provided anywhere within the internals of the printing machine and units that can be controlled by the processor (as opposed to a simple door switch) to allow the processor to selectively illuminate different internal areas of the printing machine.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A printing apparatus comprising:

a body;

a media path comprising at least one media movement and support element within said body of said printing apparatus, said media path moving sheets of media through said body of said printing apparatus;

a marking engine within said body of said printing apparatus, said media path supplying said sheets of media to said marking engine;

a processor within said body of said printing apparatus, said processor being operatively connected to said marking engine, said processor controlling actions of said marking engine;

sensors within said body of said printing apparatus, said sensors being operatively connected to said processor, said sensors being positioned along said media path, said sensors detecting locations and conditions of said sheets of media as said sheets of media travel along said media path;

clip connectors within said body of said printing apparatus, said clip connectors being connected to said sensors; and light structures within said body of said printing apparatus connected to said clip connectors, said light structures having an identical shape as said sensors for connecting to said clip connectors, said sensors detecting a paper jam within said media path, and said processor only activating ones of said light structures within said body of said printing apparatus that are adjacent to said paper jam when said sensors detect said paper jam.

2. The printing apparatus according to claim 1, further comprising:

at least one of doors and drawers on said body of said printing apparatus, said doors and drawers allowing access to internal areas of said body of said printing apparatus; and door and drawer sensors on said doors and drawers, said door and drawer sensors being operatively connected to said processor, said processor activating said light structures when said door and drawer sensors detect at least one of said doors and drawers being open to illuminate said internal areas of said body of said printing apparatus.

3. The printing apparatus according to claim 1, said processor sequentially activating different one of said light structures as said processor progresses through a paper jam clearing process coordinated with a user clearing said paper jam.

4. The printing apparatus according to claim 1, said light structures comprising at least one of light emitting diodes, incandescent light structures, fluorescent light structures, gas light structures, and vapor light structures.

5. The printing apparatus according to claim 1, said sensors and said light structures having first catches that correspond to second catches on said clip connectors.

6. The printing apparatus according to claim 1, said clip connectors, said sensors, and said light structures having solderless electrical connections.

7. A printing apparatus comprising:

a body;

a media path comprising at least one media movement and support element within said body of said printing apparatus, said media path moving sheets of media through said body of said printing apparatus;

a marking engine within said body of said printing apparatus, said media path supplying said sheets of media to said marking engine;

a processor within said body of said printing apparatus, said processor being operatively connected to said marking engine, said processor controlling actions of said marking engine;

sensors within said body of said printing apparatus, said sensors being operatively connected to said processor, said sensors being positioned along said media path, said sensors detecting locations and conditions of said sheets of media as said sheets of media travel along said media path, said sensors having a first clip shape;

clip connectors within said body of said printing apparatus, said clip connectors being connected to said sensors;

light structures within said body of said printing apparatus connected to said clip connectors, said light structures having an identical shape as said sensors for connecting to said clip connectors; and a graphic user interface on said body of said printing apparatus and operatively connected to said processor, said sensors detecting a paper jam within said media path, said graphic user interface providing sequential instructions to guide a user through a multi-step process of checking different areas of said media path to remove said paper jam, and said processor sequentially activating different ones of said light structures within said body of said printing apparatus to illuminate said different areas of said media path in coordination with said sequential instructions.

8. The printing apparatus according to claim 7, further comprising:

at least one of doors and drawers on said body of said printing apparatus, said doors and drawers allowing access to internal areas of said body of said printing apparatus; and door and drawer sensors on said doors and drawers, said door and drawer sensors being operatively connected to said processor, said processor activating said light structures when said door and drawer sensors detect at least one of said doors and drawers being open to illuminate said internal areas of said body of said printing apparatus.

9. The printing apparatus according to claim 7, wherein when said processor is performing said sequentially activating of said different ones of said light structures in coordination with said sequential instructions, said processor only activates at least one of said light structures located in an area of said media path about which said graphic user interface is currently providing paper jam clearing instructions and deactivates all other ones of said lighting structures.

10. The printing apparatus according to claim 7, said light structures being positioned and being sized to have a luminance level sufficient to illuminate said paper jam.

11. The printing apparatus according to claim 7, said light structures comprising at least one of light emitting diodes, incandescent light structures, fluorescent light structures, gas light structures, and vapor light structures.

12. The printing apparatus according to claim 7, said sensors and said light structures having first catches that correspond to second catches on said clip connectors.

13. The printing apparatus according to claim 7, said clip connectors, said sensors, and said light structures having solderless electrical connections.

14. A printing apparatus comprising:

a body;

a media supply operatively connected to said body of said printing apparatus, said media supply storing sheets of media;

a media path comprising at least one media movement and support element within said body of said printing apparatus, said media path having a beginning, a middle, and an end, said media path moving said sheets of media through said body of said printing apparatus, and said beginning of said media path being adjacent said media supply;

a marking engine within said body of said printing apparatus, said middle of said media path being adjacent said marking engine, said media path supplying said sheets of media to said marking engine, and said marking engine printing marks on said sheets of media in a printing process to create printed sheets;

a media exit operatively connected to said body of said printing apparatus, said end of said media path being adjacent said media exit, and said media path moving said printed sheets from said marking engine to said media exit;

a processor within said body of said printing apparatus, said processor being operatively connected to said marking engine, said processor controlling actions of said marking engine;

sensors within said body of said printing apparatus, said sensors being operatively connected to said processor, said sensors being positioned along said media path, said sensors detecting locations and conditions of said sheets of media as said sheets of media travel along said media path, said sensors having a first clip shape;

clip connectors within said body of said printing apparatus, said clip connectors being connected to said sensors, said clip connectors providing electrical communication between said sensors and said processor, said clip connectors having a second clip shape corresponding to and fitting said first clip shape, and said first clip shape and said second clip shape forming a physical connection between said sensors and clip connectors; and light structures within said body of said printing apparatus, said light structures being connected to said clip connectors, said clip connectors providing electrical power to said light structures, said light structures having said first clip shape, and said first clip shape and said second clip shape forming a physical connection between said light structures and clip connectors, a graphic user interface on said body of said printing apparatus and operatively connected to said processor, said sensors detecting a paper jam within said media path, said graphic user interface providing sequential instructions to guide a user through a multi-step process of checking different areas of said media path to remove said paper jam, and said processor sequentially activating different ones of said light structures within said body of said printing apparatus to illuminate said different areas of said media path in coordination with said sequential instructions.

15. The printing apparatus according to claim 14, further comprising:

at least one of doors and drawers on said body of said printing apparatus, said doors and drawers allowing access to internal areas of said body of said printing apparatus; and door and drawer sensors on said doors and drawers, said door and drawer sensors being operatively connected to said processor, said processor activating said light structures when said door and drawer sensors detect at least one of said doors and drawers being open to illuminate said internal areas of said body of said printing apparatus.

16. The printing apparatus according to claim 14, wherein when said processor is performing said sequentially activating of said different ones of said light structures in coordination with said sequential instructions, said processor only activates at least one of said light structures located in an area of said media path about which said graphic user interface is currently providing paper jam clearing instructions and deactivates all other ones of said lighting structures.

17. The printing apparatus according to claim 14, said light structures being positioned and being sized to have a luminance level sufficient to illuminate said paper jam.

18. The printing apparatus according to claim 14, said light structures comprising at least one of light emitting diodes, incandescent light structures, fluorescent light structures, gas light structures, and vapor light structures.

19. The printing apparatus according to claim 14, said sensors and said light structures having first catches that correspond to second catches on said clip connectors.

* * * * *